US006911636B2

(12) United States Patent
Shon

(10) Patent No.: US 6,911,636 B2
(45) Date of Patent: Jun. 28, 2005

(54) COOLING FAN FOR MICROWAVE OVEN

(75) Inventor: Sang Bum Shon, Seoul (KR)

(73) Assignee: LG Electronics Inc., Seoul (KR)

( * ) Notice: Subject to any disclaimer, the term of this patent is extended or adjusted under 35 U.S.C. 154(b) by 118 days.

(21) Appl. No.: 10/162,634

(22) Filed: Jun. 6, 2002

(65) Prior Publication Data

US 2003/0121915 A1 Jul. 3, 2003

(30) Foreign Application Priority Data

Jan. 3, 2002 (KR) ..... 2002-254
Jan. 9, 2002 (KR) ..... 2002-1276

(51) Int. Cl.[7] ..... H05B 6/80
(52) U.S. Cl. ..... 219/757; 126/21 A
(58) Field of Search ..... 219/757, 681, 219/685, 400; 126/21 A, 21 R; 416/234, 243, DIG. 2, DIG. 5, 238, 208.1

(56) References Cited

U.S. PATENT DOCUMENTS 4,661,669 A * 4/1987 Matsushima et al. ..... 219/757
5,798,505 A * 8/1998 Lee ..... 219/681

FOREIGN PATENT DOCUMENTS

GB 2302141 A * 1/1997 ..... F04D/29/32

* cited by examiner

*Primary Examiner*—Quang T. Van
(74) *Attorney, Agent, or Firm*—Birch, Stewart, Kolasch & Birch, LLP

(57) ABSTRACT

Disclosed is a cooling fan for a microwave oven, adapted for directing axially sucked airflow to be evenly distributed over a magnetron and a high voltage transformer. The cooling fan comprises a mixed flow fan having a specified hub angle, or an axial flow fan having optimized design parameters such as a ratio of an outer diameter of the fan to a width of a electric device chamber defined in a cabinet, a hub ratio, a sweep angle, a pitch angle, a maximum camber rate, etc.

8 Claims, 7 Drawing Sheets

COOLING FAN FOR MICROWAVE OVEN

BACKGROUND OF THE INVENTION

1. Field of the Invention

The present invention relates to a cooling fan for cooling a magnetron and a high voltage transformer disposed in a electric device chamber of a microwave oven, and more particularly, the present invention relates to a cooling fan for a microwave oven, which comprises a mixed flow fan having a specified hub angle, or an axial flow fan having optimized design parameters such as a ratio of an outer diameter of the fan to a width of a electric device chamber defined in a cabinet, a hub ratio, a sweep angle, a pitch angle, a maximum camber rate, etc.

2. Description of the Related Art

Generally, a microwave oven serves as an electric home appliance which is operated to induce increased molecular motion of water contained in a food item using high-frequency electromagnetic waves, cause molecules of water to vibrate, and generate heat within the food item to thereby cook the food item in a short period of time.

A space defined in a cabinet of a microwave oven is divided into a cooking chamber in which a food item is cooked, and a electric device chamber in which various electric devices are disposed.

FIG. 1 is a side cross-sectional view illustrating a state wherein a conventional cooling fan is disposed in a electric device chamber of a microwave oven.

As shown in FIG. 1, in the electric device chamber of the microwave oven, there are disposed up and down a magnetron 12 for radiating high frequency waves into a cooking chamber (not shown) defined in a cabinet 2 and a high voltage transformer 14 for applying a high voltage to the magnetron 12. A cooling fan 20 is arranged behind the magnetron 12 and high voltage transformer 14 to supply airflow and cool them. The cooling fan 20 is driven by a motor 16.

Conventionally, the cooling fan 20 comprises an axial flow fan which sucks air through air suction holes 2*a* defined in a rear wall of the cabinet 2 and discharges the air in an axial direction. The axial flow fan 20 has a hub 22 which is coupled to an output shaft 16*a* of the motor 16 to be integrally rotated therewith and a plurality of blades 24 which are installed on a circumferential outer surface of the hub 22 to be spaced apart one from another by a predetermined angle.

The axial flow fan 20 is arranged behind the magnetron 12 and high voltage transformer 14 which are disposed up and down in the electric device chamber. Concretely speaking, in order to ensure that airflow is evenly distributed over the magnetron 12 and high voltage transformer 14, the axial flow fan 20 is located between the magnetron 12 and high voltage transformer 14 along a vertical direction.

However, the conventional microwave oven constructed as mentioned above suffers from defects in that, since the magnetron 12 and high voltage transformer 14 are disposed up and down in the electric device chamber and the axial flow fan 20 is arranged behind them, a some portion of the airflow discharged at a high velocity from the axial flow fan 20 simply passes through a space which is defined between a lower end of the magnetron 12 and an upper end of the high voltage transformer 14. As a consequence, a cooling efficiency of the cooling fan 20 cannot but be deteriorated.

FIG. 2 is a perspective view independently illustrating the conventional cooling fan 20 of FIG. 1, and FIG. 3 is a partial side view illustrating a distal end of the blade 24 which forms a part of the cooling fan 20 shown in FIG. 1.

In the conventional axial flow fan 20, a ratio between an outer diameter of the fan 20 and a width of the electric device chamber defined in the cabinet 2, as measured on a z-axis of FIG. 1, is 0.74, a hub ratio between outer diameters of the hub 22 and the axial flow fan 20 is 0.23, a sweep angle is 0~32°, and a pitch angle is 31~45°.

Here, the pitch angle denotes an angle which is defined between a straight line connecting a leading edge LE to a trailing edge TE of the blade 24 and a line diametrically extending through the hub 22. Therefore, the pitch angle indicates a degree to which the blade 24 is inclined with respect to a plane perpendicular to the output shaft 16*a* of the motor 16.

Nevertheless, the conventional axial flow fan 20 configured as described above has disadvantages in that, when the axial flow fan 20 is driven by the motor 16 to be rotated at 2856 RPM, a volume flow rate sucked into the cabinet 2 is 1.73 CMM, and under this condition, a noise level reaches 43.1 dB[A], whereby considerable air suction noise is generated during rotation of the blades 24.

Also, when considering the fact that, as shown in FIG. 3, each blade 24 has a positive-pressure acting surface 24*b* on which a positive pressure is applied due to air suction and a negative-pressure acting surface 24*c* on which a negative pressure is applied due to air discharge, and a blade tip 24*a* formed between distal ends of the positive-pressure acting surface 24*b* and negative-pressure acting surface 24*c* has a slightly curved cross-section, since a static pressure regaining phenomenon quickly occurs in the air flowing from the positive-pressure acting surface 24*b* over the blade tip 24*a* toward the negative-pressure acting surface 24*c*, a noise level is further increased.

SUMMARY OF THE INVENTION

Accordingly, the present invention has been made in an effort to solve the problems occurring in the related art, and an object of the present invention is to provide a cooling fan for a microwave oven, which is adapted for directing axially sucked airflow to be evenly distributed over a magnetron and a high voltage transformer, thereby improving a cooling efficiency.

Another object of the present invention is to provide a cooling fan for a microwave oven, which is configured to have optimized design parameters such as a ratio of an outer diameter of the fan to a width of a electric device chamber defined in a cabinet, a hub ratio, a sweep angle, a pitch angle, a maximum camber rate, etc., thereby suppressing a noise level and increasing a volume flow rate.

In order to achieve the first mentioned object, according to one aspect of the present invention, there is provided a cooling fan for a microwave oven comprising: a mixed flow fan having a specified hub angle.

Further, in order to achieve the second mentioned object, according to another aspect of the present invention, there is provided a cooling fan for a microwave oven comprising: an axial flow fan having optimized design parameters such as a ratio of an outer diameter of the fan to a width of a electric device chamber defined in a cabinet, in which a magnetron and a high voltage transformer are disposed, a hub ratio, a sweep angle, a pitch angle, a maximum camber rate, etc.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
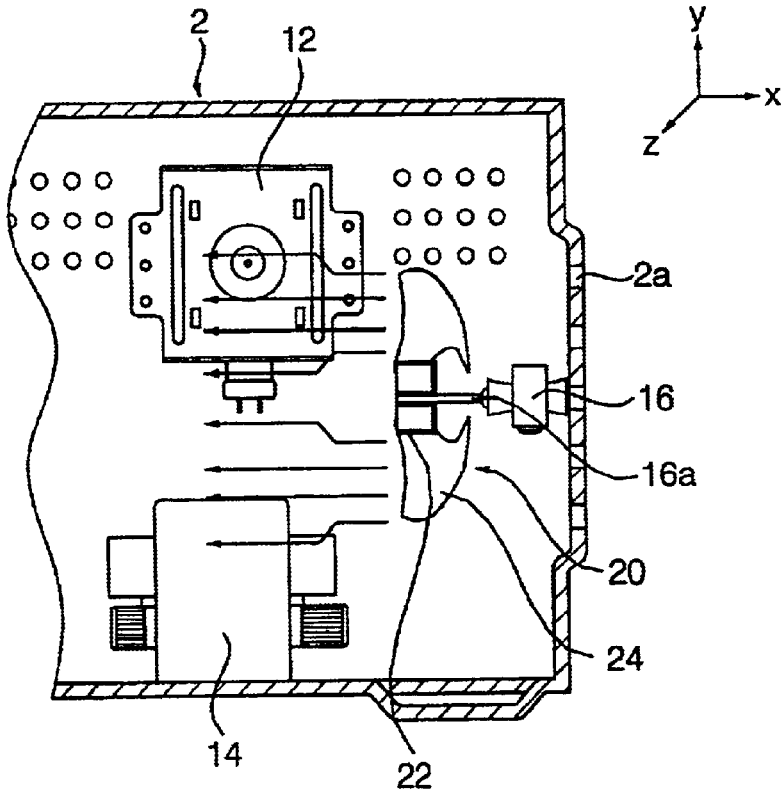
FIG. 1(Prior Art)
FIG. 1 is a side cross-sectional view illustrating a state wherein a conventional cooling fan is disposed in a electric device chamber of a microwave oven.
Figure 2:
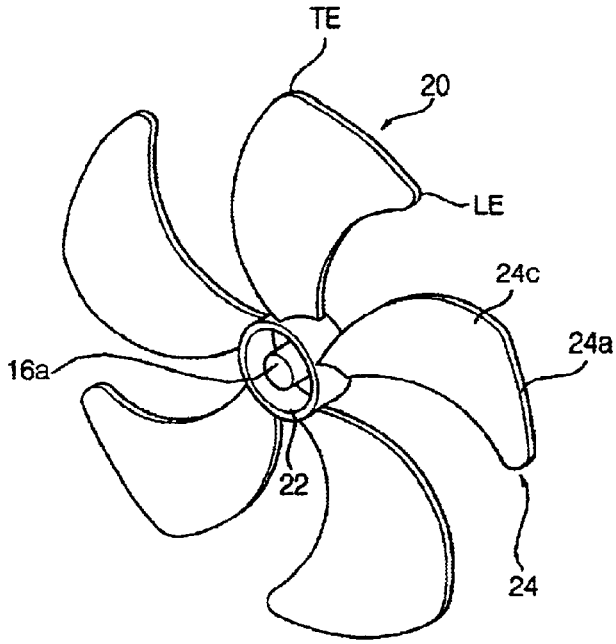
FIG. 2(Prior Art)
FIG. 2 is a perspective view independently illustrating the conventional cooling fan of FIG. 1.
Figure 3:
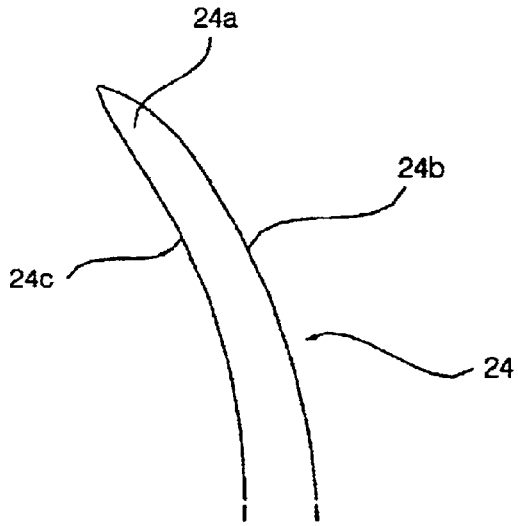
FIG. 3(Prior Art)
FIG. 3 is a partial side view illustrating a distal end of a blade which forms a part of the cooling fan shown in FIG. 1.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 4:
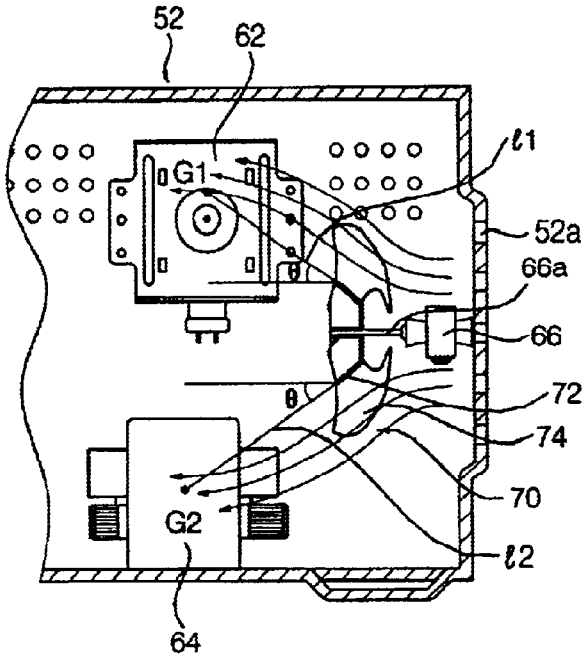
FIG. 4 is a side cross-sectional view illustrating a state wherein a cooling fan in accordance with a first embodiment of the present invention is disposed in a electric device chamber of a microwave oven.
Figure 5:
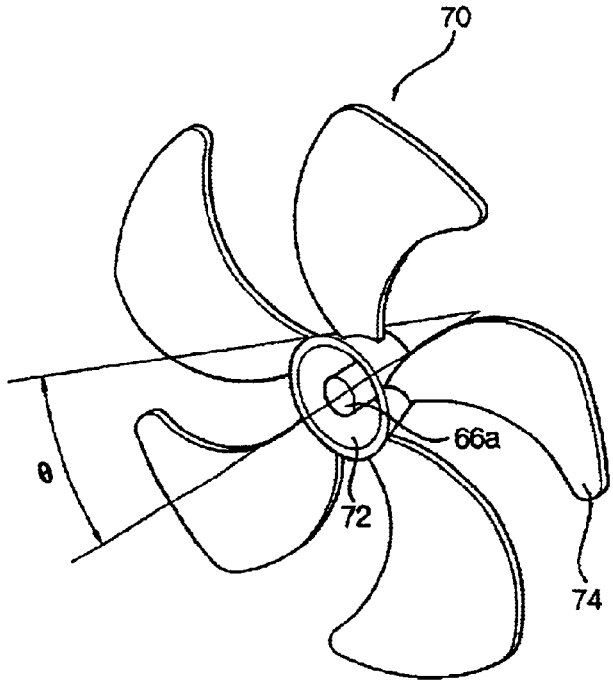
FIG. 5 is a perspective view independently illustrating the cooling fan according to the first embodiment of the present invention.

FIG. 4 is a side cross-sectional view illustrating a state wherein a cooling fan in accordance with a first embodiment of the present invention is disposed in a electric device chamber of a microwave oven, and FIG. 5 is a perspective view independently illustrating the cooling fan according to the first embodiment of the present invention.

As shown in FIG. 4, in the electric device chamber of the microwave oven, there are disposed up and down a magnetron 62 for radiating high frequency waves into a cooking chamber (not shown) defined in a cabinet 52 and a high voltage transformer 64 for applying a high voltage to the magnetron 62. A mixed flow fan 70 is arranged behind the magnetron 62 and high voltage transformer 64 to direct axially sucked airflow in a manner such that the airflow is evenly distributed over the magnetron 62 and high voltage transformer 64. The mixed flow fan 70 is driven by a motor 66.

As shown in FIG. 5, the mixed flow fan 70 has a hub 72 which is coupled to an output shaft 66*a* of the motor 66 to be integrally rotated therewith and a plurality of blades 74 which are installed on a circumferential outer surface of the hub 72 to be spaced apart one from another by a predetermined angle.

The hub 72 is formed in a manner such that a hub angle θ measured between a center of the output shaft 66*a* of the motor 66 and the circumferential outer surface of the hub 72 is within the range of 20~40°.

The hub 72 of the mixed flow fan 70 is formed in a manner such that a first prolongation 11 of a line, which extends on the circumferential outer surface of the hub 72 and exists on a first plane orthogonal to an axis of the hub 72, passes through a first center of gravity G1 of the magnetron 62, and a second prolongation of a line, which extends on the circumferential outer surface of the hub 72 and exists on a second plane orthogonal to the axis of the hub 72, passes through a second center of gravity G2 of the high voltage transformer 64.

As a consequence, if the mixed flow fan 70 is operated, air sucked in an axial direction through air suction holes 52*a* defined in a rear wall of the cabinet 52 is guided by the hub 72 toward the magnetron 62 and high voltage transformer 64 which are disposed up and down in the electric device chamber. At this time, no portion of the airflow supplied by the mixed flow fan 70 simply passes through a space which is defined between a lower end of the magnetron 62 and an upper end of the high voltage transformer 64. Therefore, since the airflow as a whole passes through the magnetron 62 and high voltage transformer 64 in a evenly distributed state to cool them, a cooling efficiency of the cooling fan is improved.

Figure 6:
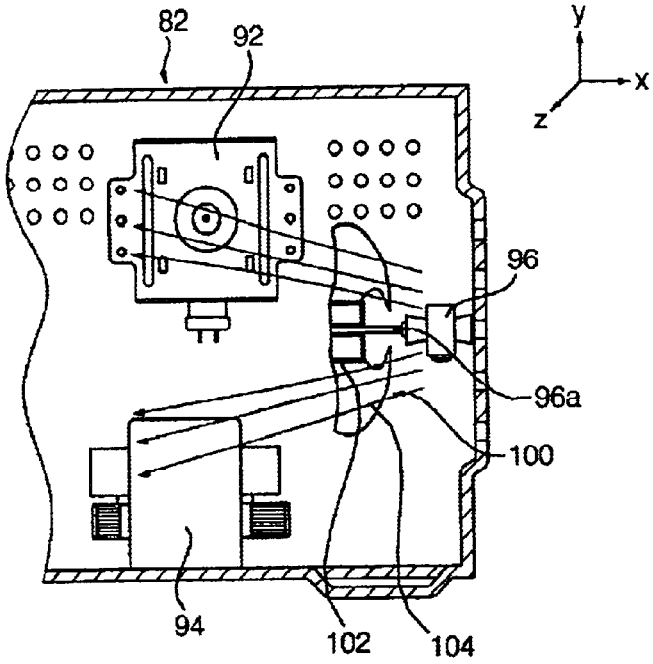
FIG. 6 is a side cross-sectional view illustrating a state wherein a cooling fan in accordance with a second embodiment of the present invention is disposed in a electric device chamber of a microwave oven.
Figure 7:
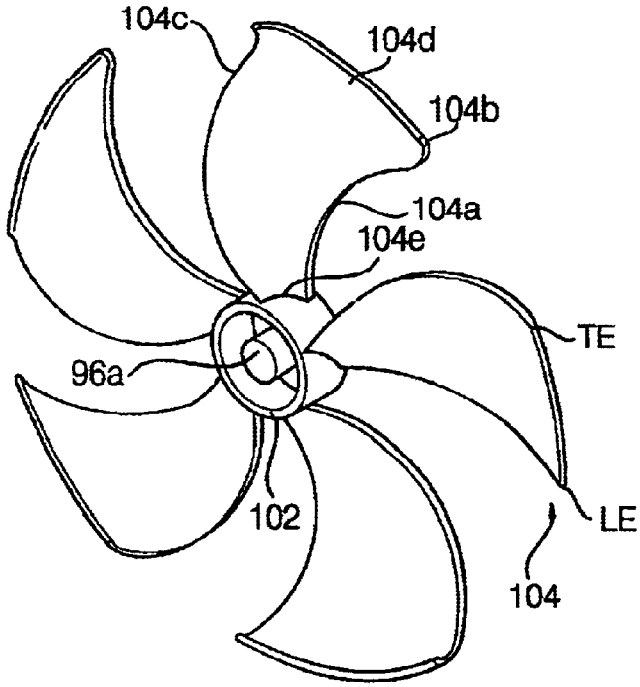
FIG. 7 is a perspective view independently illustrating the cooling fan according to the second embodiment of the present invention.
Figure 8:
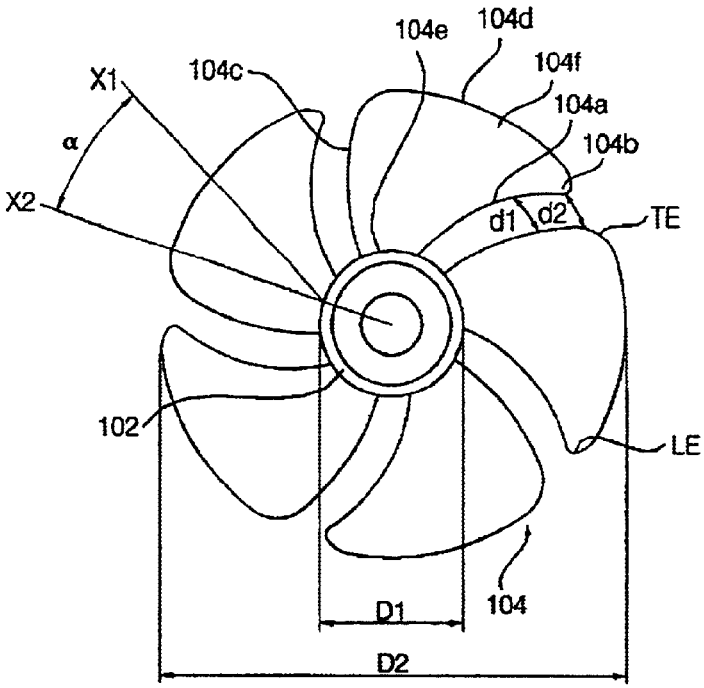
FIG. 8 is a front view of the cooling fan according to the second embodiment of the present invention.
Figure 9:
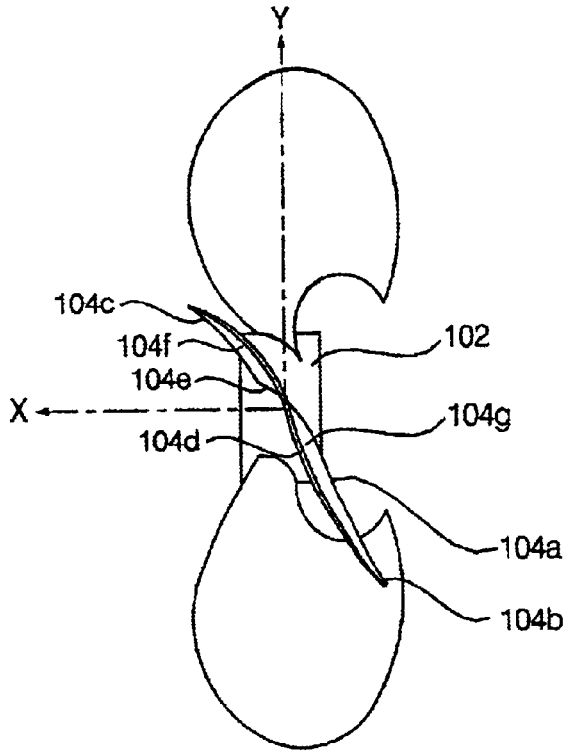
FIG. 9 is a side view of the cooling fan according to the second embodiment of the present invention.

FIG. 6 is a side cross-sectional view illustrating a state wherein a cooling fan in accordance with a second embodiment of the present invention is disposed in a electric 110 device chamber of a microwave oven, FIG. 7 is a perspective view independently illustrating the cooling fan according to the second embodiment of the present invention, FIG. 8 is a front view of the cooling fan according to the second embodiment of the present invention, and FIG. 9 is a side view of the cooling fan according to the second embodiment of the present invention.

As shown in FIG. 6, the cooling fan according to this second embodiment of the present invention comprises an axial flow fan 100 arranged behind a magnetron 92 and a high voltage transformer 94 which are disposed up and down in the electric device chamber defined in a cabinet 82.

Of course, as shown in FIGS. 6 and 7, the axial flow fan 100 has a hub 102 which is coupled to an output shaft 96*a* of a motor 96 to be integrally rotated therewith and a plurality of blades 104 which are installed on a circumferential outer surface of the hub 102 to be spaced apart one from another by a predetermined angle.

As shown in FIGS. 6, 8 and 9, the axial flow fan 100 is formed in a manner such that a ratio of an outer diameter D2 of the fan 100 to a width L1 of the electric device chamber defined in the cabinet 82, as measured on a z-axis of FIG. 6, is no less than 0.8, and a hub ratio of an outer diameter D1 of the hub 102 to the outer diameter D2 of the fan 100 is in the range of 0.28~0.32.

Concretely speaking, in the axial flow fan 100 according to this preferred embodiment of the present invention, the width L1 of the electric device chamber of the cabinet 82 corresponds to 145 mm, the ratio of the outer diameter D2 of the fan 100 to the width L1 of the electric device chamber of the cabinet 82 corresponds to 0.83, and the hub ratio corresponds to 0.3. As a consequence, the axial flow fan 100 has an outer diameter D2 of 120.35 mm, and the hub 102 has an outer diameter D1 of 36.105 mm.

Meanwhile, in view of various considerations such as a cooling efficiency, a volume flow rate, an air pressure, and so forth, it is preferred that the axial flow fan 100 has five blades 104. In the case that the axial flow fan 100 is rotated in a clockwise direction, each blade 104 has a contour in which both side surfaces are curved in a counterclockwise direction.

Here, a front side surface of each blade 104, which is positioned upstream in the clockwise rotating direction of the axial flow fan 100, serves as a front edge 104*a*, and a rear side surface of each blade 104, which is positioned downstream in the clockwise rotating direction of the axial flow fan 100, serves as a rear edge 104*c*. A protruded part 104*b* is formed at a distal end of the front edge 104*a* in a manner such that it projects forward when viewed in the clockwise rotating direction.

An outer peripheral surface of each blade 104, which connects distal ends of the front and rear edges 104*a* and 104*c* with each other, serves as an outer edge (hereinafter, referred to as a "blade tip") (104*d*), and an inner peripheral surface of each blade 104, which is opposed to the blade tip 104*d* and is secured to the circumferential outer surface of the hub 102, serves as an inner edge (hereinafter, referred to as a "blade root") (104*e*).

An apex of the front edge 104*a* serves as a leading edge LE, and an apex of the rear edge 104*c* serves as a trailing edge TE.

Each blade 104 is formed to have a predetermined curvature between the front and rear edges 104*a* and 104*c* in a manner such that rear end portions of the blade tip 104*d* and blade root 104*e* on the rear edge 104*c* are positioned closer to an exit end of the hub 102 than front end portions of the blade tip 104*d* and blade root 104*e*. Each blade 104 has a positive-pressure acting surface 104*g* on which a positive pressure is applied due to air suction and a negative-pressure acting surface 104*f* on which a negative pressure is applied due to air discharge.

Each blade 104 of the present invention is formed to have a sweep angle $\alpha$ of 26~30°.

The sweep angle $\alpha$ denotes a degree to which the blade 104 is inclined in the clockwise rotating direction. The sweep angle $\alpha$ is defined by a first line X1 which connects centers of the blade tip 104*d* and blade root 104*e* with each other and a second line X2 which connects centers of the blade root 104*e* and hub 102 with each other.

The blade 104 has a first pitch angle $\beta$ of 43° when measured at the blade root 104*e* and a second pitch angle $\beta$ of 29.7° when measured at the blade tip 104*d*. Therefore, each blade 104 has a pitch angle $\beta$ which varies within the range of 43~29.7° between the blade tip 104*d* and blade root 104*e*.

The pitch angle $\beta$ indicates a degree to which the blade 104 is inclined with respect to a plane perpendicular to the output shaft 96*a* of the motor 96. Thus, the pitch angle $\beta$ denotes an angle which is defined between a straight line connecting the leading edge LE to the trailing edge TE of the blade 104 and a y-axis orthogonal to an x-axis serving as a rotational axis.

The pitch angle $\beta$ functions to disperse a great load exerted to the blade tip 104*d* while the axial flow fan 104 is rotated, in such a way as to minimize flow separation. Hence, the pitch angle $\beta$ serves as a design parameter which suppresses a noise level upon fluid flow and increases a volume flow rate.

The blade 104 has a width of 42.94 mm when measured between the distal ends of the front and rear edges 104*a* and 104*c*. Two adjoining blades 104 are separated from each other by a first distance of 6~8 mm at their blade roots 104*e*, and by a second distance of 23~25 mm at their blade tips 10*d*. Also, the two adjoining blades 104 are separated from each other by a third distance of 11~13 mm at points dl which correspond to 0.75 of a length between the blade tip 104*d* and the blade root 104*e* when measured from the blade roots 104*e*, and by a fourth distance of 8~10 mm at points d2 which correspond to 0.95 of the length between the blade tip 104*d* and the blade root 104*e* when measured from the blade roots 104*e*.

Figure 10:
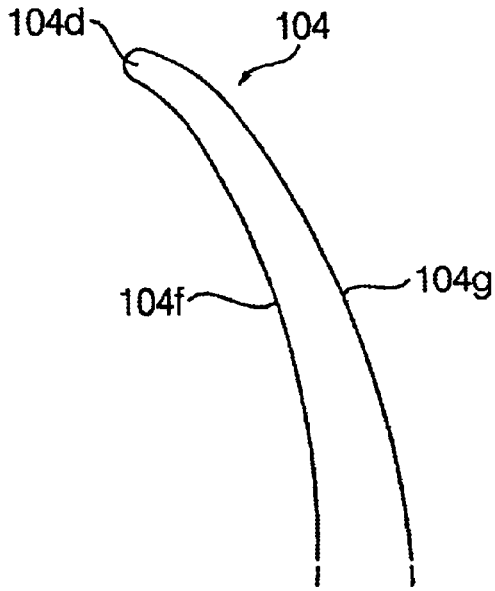
FIG. 10 is a partial side view illustrating a distal end of a blade which forms a part of the cooling fan according to the second embodiment of the present invention.
Figure 11:
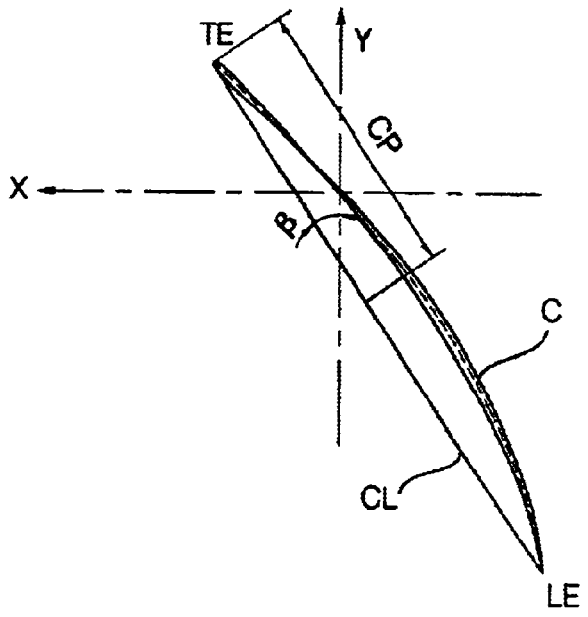
FIG. 11 is a cross-sectional view illustrating a state wherein the blade of FIG. 10 is cut in a widthwise direction.

FIG. 10 is a partial side view illustrating a distal end of the blade which forms a part of the cooling fan according to the second embodiment of the present invention, and FIG. 11 is a cross-sectional view illustrating a state wherein the blade of FIG. 10 is cut in a widthwise direction.

As shown in FIG. 10, the blade 104 is formed in a manner such that it is curved from the positive-pressure acting surface 104*g* toward the negative-pressure acting surface 104*f* over a distance of 8 mm measured from the blade tip 104*d* toward the blade root 104*e*, to have a preselected curvature.

Consequently, since a static pressure regaining phenomenon slowly occurs in the air flowing from the positive-pressure acting surface 104*g* over the blade tip 104*d* toward the negative-pressure acting surface 104*f*, it is possible to minimize generation of vortex flow at the blade tip 104*d*.

As shown in FIG. 11, the blade 104 has a maximum camber position CP of 0.53 which is constantly maintained from the blade tip 104*d* to the blade root 104*e*. Also, the blade 104 has a first maximum camber rate of 4% when measured at the blade root 104*e* and a second maximum camber rate of 9.3% when measured at the blade tip 104*d*.

The maximum camber position CP denotes a position on the blade 104, which is farthest separated from a chord CL as a straight line connecting the leading edge LE and trailing edge TE with each other. A maximum camber C is represented by a distance between the chord CL and the blade 104. The maximum camber rate is a percentage representation of a ratio between the maximum camber C and a length of the chord CL.

In TABLE 1, the blade 104 according to the present invention, configured as mentioned above, is compared with the conventional blade for an axial flow fan. That is to say, design parameters of the present blade B and conventional blade A are compared with each other in TABLE 1.

Figure 12:
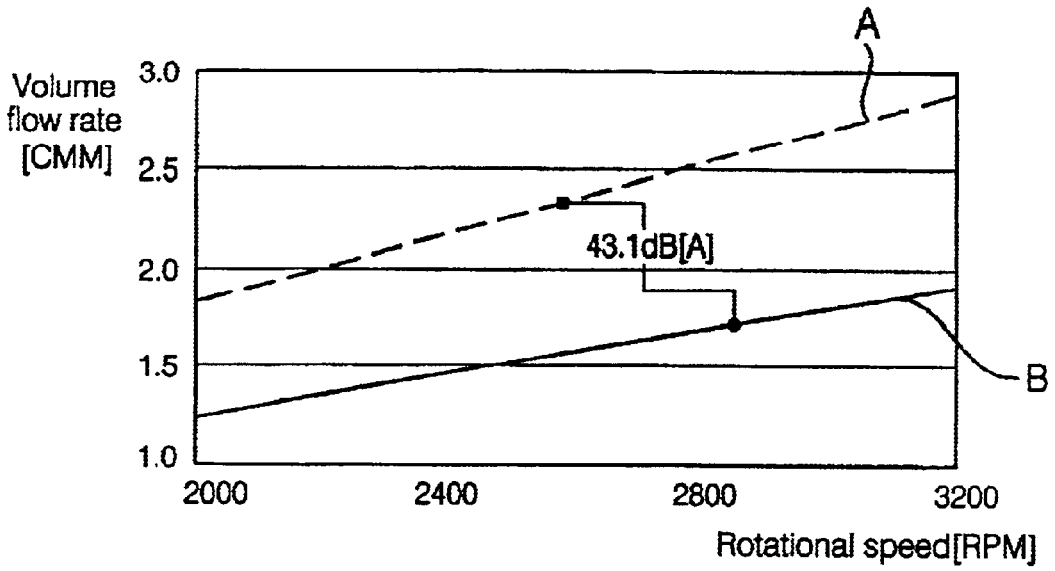
FIG. 12 is a graph comparing cooling fans of the present invention and conventional art with each other in terms of rotational speed and volume flow rate.
Figure 13:
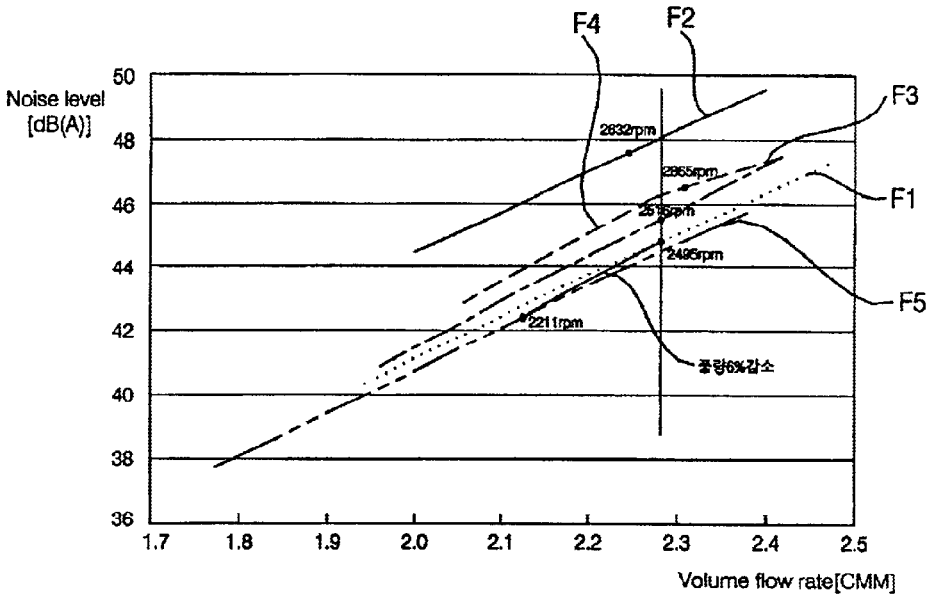
FIG. 13 is a graph comparing an axial flow fan of the present invention with comparative axial flow fans in terms of volume flow rate and noise level.

FIG. 12 is a graph comparing cooling fans of the present invention and conventional art with each other in terms of rotational speed and volume flow rate, and FIG. 13 is a graph comparing the axial flow fan of the present invention with comparative axial flow fans in terms of volume flow rate and noise level.

TABLE 1

| | Conventional axial flow fan (A) | Present axial flow fan (B) |
|---|---|---|
| Number of blades | 5 | 5 |
| Width of electric device chamber (mm) | 145 | 145 |
| Outer diameter (mm) | 108 | 120 |
| Inner diameter (mm) | 25 | 36 |
| Outer diameter/width of electric device chamber | 0.74 | 0.83 |
| Outer diameter/inner diameter | 0.23 | 0.3 |
| Sweep angle (°) | 32 | 28 |
| Pitch angle (°) | 45~31 | 43~29.7 |

As can be readily seen from FIG. 12, when a noise level is 43.1 dB[A], the conventional axial flow fan A has a rotational speed of 2856 RPM and a volume flow rate of 1.73 CMM, and the present axial flow fan has a rotational speed of 2495 RPM and a volume flow rate of 2.29 CMM.

At the same noise level, in the case of the present axial flow fan B, the rotational speed is reduced by no less than 10% and a volume flow rate is increased by no less than 30%. Accordingly, it is to be readily understood that the present axial flow fan B is significantly improved in terms of cooling efficiency and noise level.

In FIG. 13, in the case of a first comparative axial flow fan F2, only a width ratio is changed to 0.74 while the other design parameters have the same values as the present axial flow fan F1. In the case of a second comparative axial flow fan F3, only a sweep angle is changed to 35° while the other design parameters have the same values as the present axial flow fan F1. In the case of third and fourth comparative axial flow fans F4 and F5, only a pitch angle range is changed to 40~27° and 46~33°, respectively, while the other design parameters have the same values as the present axial flow fan F1.

A person skilled in the art will readily recognize from FIG. 13 that the present axial flow fan F1 is superior to the first through fourth comparative axial flow fans F1 through F4 in terms of volume flow rate and noise level.

When considering the case where the present axial flow fan F1 and the fourth comparative axial flow fan F4 are rotated at the same velocity of 2495 RPM, in the case of the fourth comparative axial flow fan F4, a volume flow rate is reduced by no less than 6% when compared to the present axial flow fan F1, whereby a cooling efficiency is deteriorated. Thus, it can be readily understood that the present axial flow fan F1 reveals excellent operational characteristics.

As apparent from the above description, the cooling fan for a microwave oven, according to the present invention, provides advantages in that, since a magnetron and a high voltage transformer are disposed up and down in a electric device chamber and a mixed flow fan having a specified hub angle is arranged behind them, air sucked into the mixed flow fan in an axial direction can be directed to be evenly distributed over the magnetron and high voltage transformer, whereby the magnetron and high voltage transformer can be effectively cooled and thereby it is possible to decrease a size of the cooling fan.

Also, because the cooling fan according to the present invention comprises an axial flow fan having optimized design parameters such as a ratio of an outer diameter of the fan to a width of the electric device chamber defined in a cabinet, a hub ratio, a sweep angle, a pitch angle, a maximum camber rate, etc., a volume flow rate is increased to improve a cooling efficiency and a noise level is reduced.

Moreover, in the cooling fan according to the present invention, due to the fact that a blade tip of the axial flow fan is curved to have a predetermined curvature, it is possible to prevent a vortex flow band from being created on a negative-pressure acting surface of a blade, whereby a noise level can be further suppressed and a volume flow rate can be further increased.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A cooling fan for a microwave oven, arranged behind a magnetron and a high voltage transformer for applying a high voltage to the magnetron, which are disposed up and down in a electric device chamber defined in a cabinet, and adapted for directing airflow toward the magnetron and high voltage transformer, the cooling fan comprising:

an axial flow fan having a ratio of an outer diameter of the fan to a width of the electric device chamber defined in the cabinet, of no less than 0.8, and wherein two adjoining blades are separated from each other by a first distance of 6~8 mm at their blade roots, a second distance of 23~25 mm at their blade tips, a third distance of 11~13 mm at points which correspond to 0.75 of a length between the blade tip and the blade root when measured from the blade roots, and a fourth distance of 8~10 mm at points which correspond to 0.95 of the length between the blade tip and the blade root when measured from the blade roots.

2. The cooling fan as set forth in claim 1, wherein the axial flow fan has a ratio of an outer diameter of the fan to a width of the electric device chamber defined in the cabinet, corresponding to 0.83.

3. The cooling fan as set forth in claim 1, wherein the axial flow fan has five blades.

4. The cooling fan as set forth in claim 1, wherein the axial flow fan has a hub ratio of 0.28~0.32.

5. The cooling fan as set forth in claim 1, wherein the blade has a first pitch angle of 29±2° when measured at a blade tip and a second pitch angle of 45±2° when measured at a blade root.

6. The cooling fan as set forth in claim 1, wherein the blade has a sweep angle 28±2°.

7. The cooling fan as set forth in claim 1, wherein the blade has a maximum camber position of 0.53 which is constantly maintained from the blade tip to the blade root, and a first maximum camber rate of 4% when measured at the blade root and a second maximum camber rate of 9.3% when measured at the blade tip.

8. The cooling fan as set forth in claim 1, wherein the blade tip is curved from a positive-pressure acting surface toward a negative-pressure acting surface of the blade to have a predetermined curvature.

* * * * *